US011387571B2

(12) United States Patent
Sato et al.

(10) Patent No.: US 11,387,571 B2
(45) Date of Patent: Jul. 12, 2022

(54) SLOT ANTENNA APPARATUS, COMMUNICATION SYSTEM, AND METHOD FOR ADJUSTING ANGLE OF RADIO WAVES EMITTED FROM SLOT ANTENNA APPARATUS

(71) Applicant: FUJITSU LIMITED, Kawasaki (JP)

(72) Inventors: Tomonori Sato, Kawasaki (JP); Shigekazu Kimura, Yokohama (JP); Toshio Kawasaki, Kawasaki (JP); Yoji Ohashi, Fucyu (JP)

(73) Assignee: FUJITSU LIMITED, Kawasaki (JP)

( * ) Notice: Subject to any disclaimer, the term of this patent is extended or adjusted under 35 U.S.C. 154(b) by 4 days.

(21) Appl. No.: 17/160,176

(22) Filed: Jan. 27, 2021

(65) Prior Publication Data

US 2021/0280987 A1 Sep. 9, 2021

(30) Foreign Application Priority Data

Mar. 9, 2020 (JP) ..... JP2020-040153

(51) Int. Cl.
*H01Q 21/06* (2006.01)
*H01Q 1/24* (2006.01)
*H01Q 13/28* (2006.01)

(52) U.S. Cl.
CPC ..... *H01Q 21/064* (2013.01); *H01Q 1/246* (2013.01); *H01Q 13/28* (2013.01)

(58) Field of Classification Search
CPC ..... H01Q 1/246; H01Q 13/28; H01Q 15/02; H01Q 15/08; H01Q 21/064
See application file for complete search history.

(56) References Cited

U.S. PATENT DOCUMENTS 6,100,846 A * 8/2000 Li ..... H01Q 13/28 343/848
6,133,887 A * 10/2000 Tanizaki ..... H01Q 25/04 333/159
2009/0174499 A1 7/2009 Hiramatsu et al.

FOREIGN PATENT DOCUMENTS

JP 2000-068733 A 3/2000
JP 2004-147169 A 5/2004
JP 2005-217864 A 8/2005
(Continued)

OTHER PUBLICATIONS

Hiroyuki Deguchi, "Research on High Performance Multi-Beam Opening Surface Antenna", Doshisha University, Faculty of Science and Engineering, Department of Electrical and Electronic Engineering (Total 9 pages).

(Continued)

*Primary Examiner* — Daniel Munoz
(74) *Attorney, Agent, or Firm* — Fujitsu Patent Center

(57) ABSTRACT

A slot antenna apparatus that includes a waveguide including a sidewall and having an extending direction, a slot provided on the sidewall, and a dielectric member that is attached to the waveguide and is slidable in the extending direction with respect to the slot, the dielectric member including a first section and a second section, the first section covering the slot at a first slide position, the second section covering the slot at a second slide position next to the first slide position, and the first section and the second section having different relative permittivities or different thicknesses with each other.

20 Claims, 15 Drawing Sheets

(56) References Cited

FOREIGN PATENT DOCUMENTS

WO 2007/114391 A1 10/2007

OTHER PUBLICATIONS

Yangjun Zhang et al., "Design and Fabrication of an Artificial Dielectric Flat Lens Antenna", vol. J95-B, No. 12, pp. 1634-1641, Dec. 2012 (Total 11 pages).

* cited by examiner

SLOT ANTENNA APPARATUS, COMMUNICATION SYSTEM, AND METHOD FOR ADJUSTING ANGLE OF RADIO WAVES EMITTED FROM SLOT ANTENNA APPARATUS

CROSS-REFERENCE TO RELATED APPLICATION

This patent application is based upon and claims the benefit of priority of the prior Japanese Patent Application No. 2020-040153 filed on Mar. 9, 2020, the entire contents of which are incorporated herein by reference.

FIELD

The embodiment discussed herein is related to a slot antenna apparatus, a communication system, and a method for adjusting angle of radio waves emitted from slot antenna apparatus.

BACKGROUND

Conventionally, there is a dielectric waveguide slot array antenna that includes a dielectric waveguide, a printed circuit board, and a metallic plate. Such dielectric waveguide has a plurality of first slots that emit electromagnetic waves at designated intervals to a surface. The printed circuit board has first through-holes located at positions opposite to the first slots respectively. The metallic plate has first penetrating holes located at positions opposite to the first slots respectively. The dielectric waveguide has a plurality of second slots formed close to the plurality of respective first slots. The printed circuit board has second through-holes located at positions opposite to the second slots respectively. The metallic plate has second penetrating holes located at positions opposite to the second slots respectively (for example, see Patent Document 1).

There is a corrugated leaky waveguide that includes a hollow conductor and through-holes formed on the hollow conductor. The through-holes are provided for leaking radio waves and are disposed at intervals in a longitudinal direction. Recesses and projections are provided in the longitudinal direction on the surface of the conductor. Either or both of the intervals of the through-holes and pitches of the recesses and the projections are irregular (for example, see Patent Document 2).

There is a slot array antenna in which a slot plate and a dielectric plate are integrated so that the dielectric plate has a tilt angle. A tilt angle θ of a radiation-directing main beam of the slot array antenna is corrected by the tilt angle of the dielectric plate (for example, Patent Document 3).

However, none of the documents describes that a slot antenna apparatus including a waveguide having a plurality of slots may be used to variably adjust an angle of radio waves emitted from each of the slots.

RELATED-ART DOCUMENTS

Patent Documents

[Patent Document 1] Japanese Laid-open Patent Publication No. 2005-217864

[Patent Document 2] Japanese Laid-open Patent Publication No. 2000-068733

[Patent Document 3] Japanese National Publication of International Patent Application No. 2004-147169

SUMMARY

According to an aspect of the present application, there is provided a slot antenna apparatus that, includes a waveguide including a sidewall and having an extending direction, a slot provided on the sidewall; and a dielectric member that is attached to the waveguide and is slidable in the extending direction with respect to the slot, the dielectric member including a first section and a second section, the first section covering the slot at a first slide position, the second section covering the slot at a second slide position next to the first slide position, the first section and the second section having different relative permittivities or different thicknesses with each other.

The object and advantages of the disclosure will be realized and attained by means of the elements and combinations particularly pointed out in the claims.

It is to be understood that both the foregoing general description and the following detailed description are exemplary and explanatory and are not restrictive of the invention as claimed.

DESCRIPTION OF EMBODIMENT

Hereinafter, embodiments to which a slot antenna apparatus, a communication system, and a method for adjusting angle of radio waves emitted from slot antenna apparatus are applied will be described.

EMBODIMENT

Figure 1:
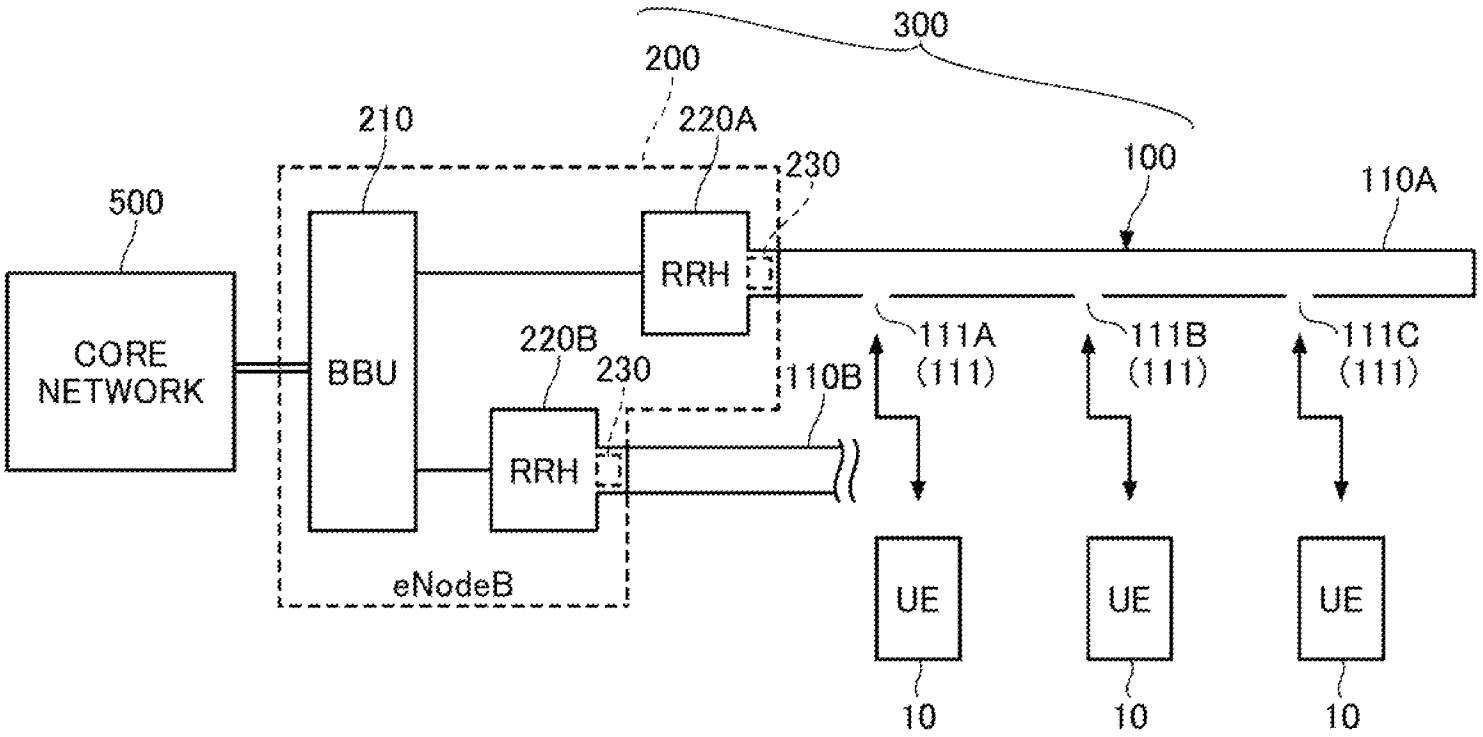
FIG. 1 is a block diagram illustrating an example of a configuration of a communication system.

FIG. 1 is a block diagram illustrating an example of a configuration of a communication system 300. The communication system 300 includes a slot antenna apparatus 100 and an evolved Node B (eNodeB) 200. The communication system 300 is a system that adopts a cellular system and performs wireless communications.

The eNodeB 200 is an example of a base station which includes a base band unit (BBU) 210, remote radio heads (RRHs) 220A and 220B, and coaxial waveguide converters 230. The eNodeB 200 is connected to a core network 500 via optical fibers. The core network 500 is a high capacity communication line and is an example of a trunk network or backbone.

The BBU 210 is an apparatus that performs a baseband processing. The BBU 210 is provided in the eNodeB 200 and is connected to the RRHs 220A and 220B via the optical fibers.

The RRHs 220A and 220B are radio apparatuses. The RRHs 220A and 220B are provided in one eNodeB 200, and two RRHs 220A and 220B are as illustrated in FIG. 1. The RRHs 220A and 220B are connected to the waveguides 110A and 110B of the slot antenna apparatus 100, respectively, via the coaxial waveguide converters 230. Each of the waveguides 110A and 110B is an example of a waveguide and is made of metal.

In a case where the RRHs 220A and 220B are not specifically distinguished, the RRH of the present embodiment is referred to as an RRH 220. In a case where the waveguides 110A and 110B are not specifically distinguished, the waveguide of the present embodiment is referred to as a waveguide 110.

The coaxial waveguide converters 230 connect coaxial cables of the RRHs 220A and 220B and the waveguides 110A and 110B of the slot antenna apparatus 100, respectively. The coaxial waveguide converters 230 are transducers that can perform bi-directional power conversion between the coaxial cables and the waveguides 110A and 110B.

The slot antenna apparatus 100 includes the waveguides 110A and 110B. The waveguide 110A includes slots 111 (111A to 111C). Although slots of the waveguide 110B are omitted in FIG. 1, the waveguide 110B includes the slots similar to the slots 111 (111A to 111C). Although the waveguide 110A includes the three slots 111 (111A to 111C), for example, the number of the slots 111 is not limited to three.

The slot 111A is closest to the RRH 220A and the slot 111C is farthest away from the RRH 220A. Hereinafter, in a case where the slots 111A to 111C are not specifically distinguished, the slot of the present embodiment is referred to as a slot ill.

The waveguide 110 is connected to the RRH 220 via the coaxial waveguide converter 230. The slots 111A to 111C emit (output) radio waves propagating inside the waveguide 110 to an exterior of the waveguide 110 and provide communication areas in which a cellular equipment can perform the wireless communications.

A user equipment (UE) 10 receives the radio waves emitted from slots 111A to 111C in the communication areas and can perform bi-directional data communication with the core network 500 via the waveguide 110 and the eNodeB 200.

The slot antenna apparatus 100 has a configuration which enables the user to variably set or adjust the amount of the radio waves emitted from each of the slots 111A to 111C. Details of the slot antenna apparatus 100 will be described below with reference to FIG. 3. The amount of the radio waves corresponds to an intensity of the radio waves and defines sizes of the communication areas.

The UE 10 is, for example, a personal computer (PC), a tablet computer, a smartphone, and other devices that can perform the wireless communications in the cellular system.

Although an embodiment in which the communication system 300 adopts the cellular system will be described, for example, the communication system 300 may adopt a wireless local area network (LAN) system. In a case where the communication system 300 adopts the wireless LAN system, the communication system 300 includes an access point (AP) instead of the eNodeB 200 and connects to the Internet instead of the core network 500 so that a terminal similar to the UE 10 can perform data communication. The terminal used in the wireless LAN system may be referred to as a station.

Figure 2:
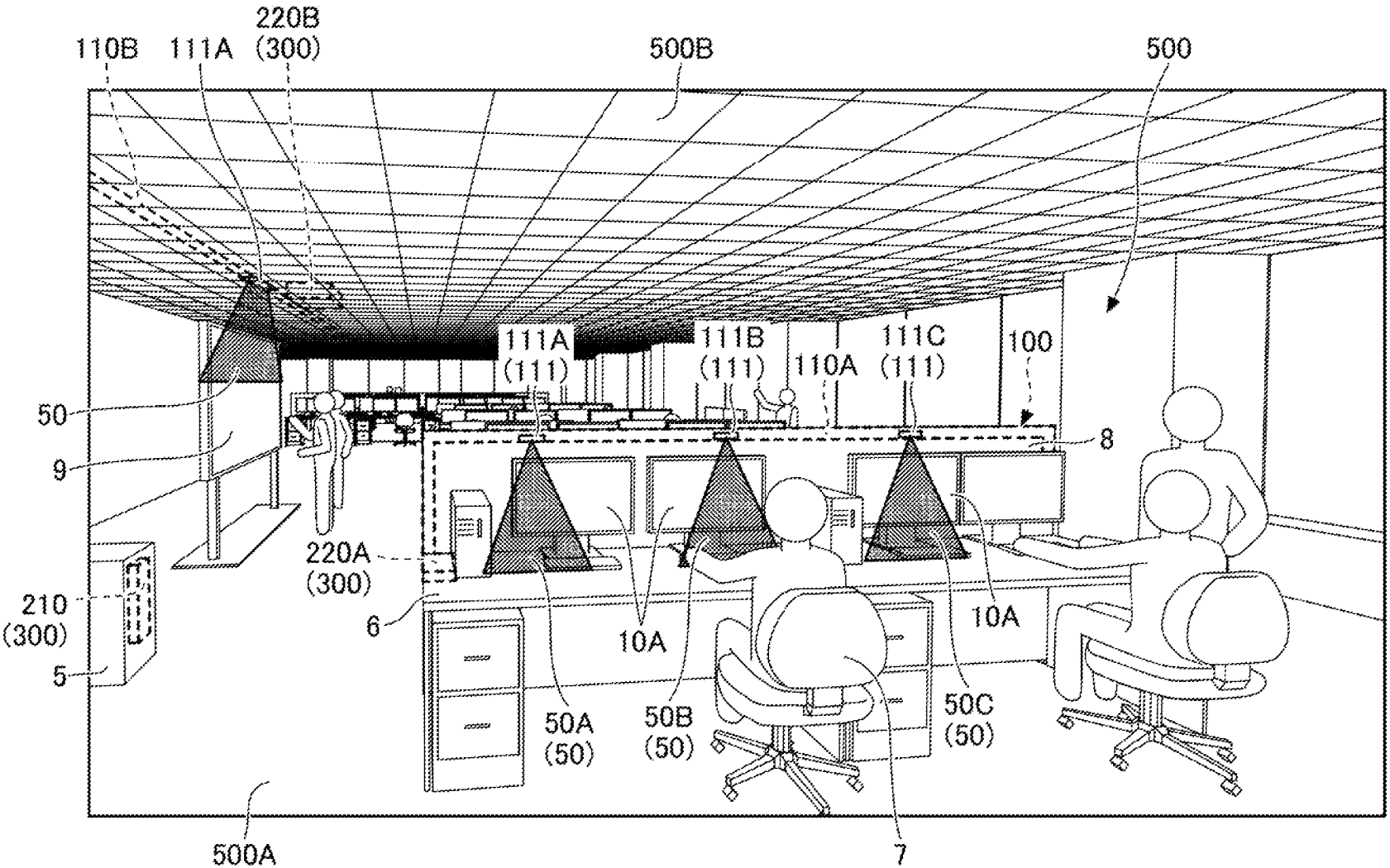
FIG. 2 is a diagram illustrating an example of an office room in which the communication system is installed.

FIG. 2 is a diagram illustrating an example of an office room 500 in which the communication system 300 is installed. FIG. 2 illustrates a shelf 5, desks 6, chairs 7, partitions 8, and a large monitor 9 or the like that are arranged on a floor 500A of the office room 500. PCs 10A are arranged on the desks 6. Employees are working in the office room 500.

The BBU 210 is disposed in the shelf 5 as an example, the RRH 220A is installed in one of the desks 6, and the RRH 220B is disposed in a rear side of a ceiling 500B. In FIG. 2, the optical fibers connecting the BBU 210 and the RRHs 220A and 220B and the coaxial waveguide converters 230 (see FIG. 1) are omitted. The RRH 220A may be installed under the floor 500A.

The waveguide 110A connected to the RRH 220A is installed along side and upper edges of the partitions 8 provided between the opposite desks 6 and has the slots 111A to 111C. The slots 111A to 111C emit the radio waves toward the desks 6 and provide communication areas 50 (50A to 50C), respectively. PCs 10A are disposed on the desks 6 and can perform the wireless communications through the radio waves emitted from the slots 111A to 111C. The waveguide 110A may be embedded in upper surfaces of the desks 6. In this case, the slots 111A to 111C may be exposed on the upper surfaces of the desks 6.

The slots 111A to 111C may be assigned for three employees working at desks 6, for example. Thus, pitches among the slots 111A to 111C correspond to pitches between workspaces of the employees at the desks 6, for example.

The pitches of the slots 111A to 111C as described above are largely different from conventional pitches between slots of a typical slot antenna. The conventional pitches are about a half wavelength to about one wavelength at a communication frequency. The pitches of the slots 111A to 111C are preferably greater than or equal to ten wavelengths at the communication frequency. In a case where the slots 111A to 111C are arranged at pitches that are greater than or equal to ten wavelengths, the radio waves emitted from the adjacent slots 111A to 111C are unlikely to interfere with each other. It becomes possible to obtain the communication areas 50A to 50C that are independent of each other.

The waveguide 110B connected to the RRH 220B is disposed in the rear side of a ceiling 500B, and the slot 111A of the waveguide 110B is exposed on the ceiling 500B. The slot 111A of the waveguide 110B emits the radio waves to the large monitor 9 and provides the communication area 50. The large monitor 9 is disposed in the communication area 50 provided by the radio waves emitted from the slot 111A of the waveguide 110B and can perform the wireless communication. The large monitor 9 displays data received in the communication area 50 provided by the slot 111A of the waveguide 110B through the wireless communication.

As described above, the communication system 300 includes the waveguide 110. The waveguide 110 has an advantage of low transmission losses, particularly in a case of transmitting data at a high frequency band (e.g., millimeter-wave band). This is an advantage of the waveguide 110 over coaxial cables which have very high transmission losses at the high frequency band, such as the millimeter-wave band. Herein, the millimeter-wave band is, for example, a frequency band ranging from about 30 GHz to about 300 GHz. An example of a cellular communication using the millimeter-wave band is a fifth generation (5G). 5G uses a 28 GHz band and a 39 GHz band. A WiFi system uses 60 GHz band provided by IEEE 802. Had (WiGig). It should be noted that the communication system 300 is not limited to communication in the millimeter-wave band(s), but may be used for communication in bands other than the millimeter-wave band(s).

Figure 3:
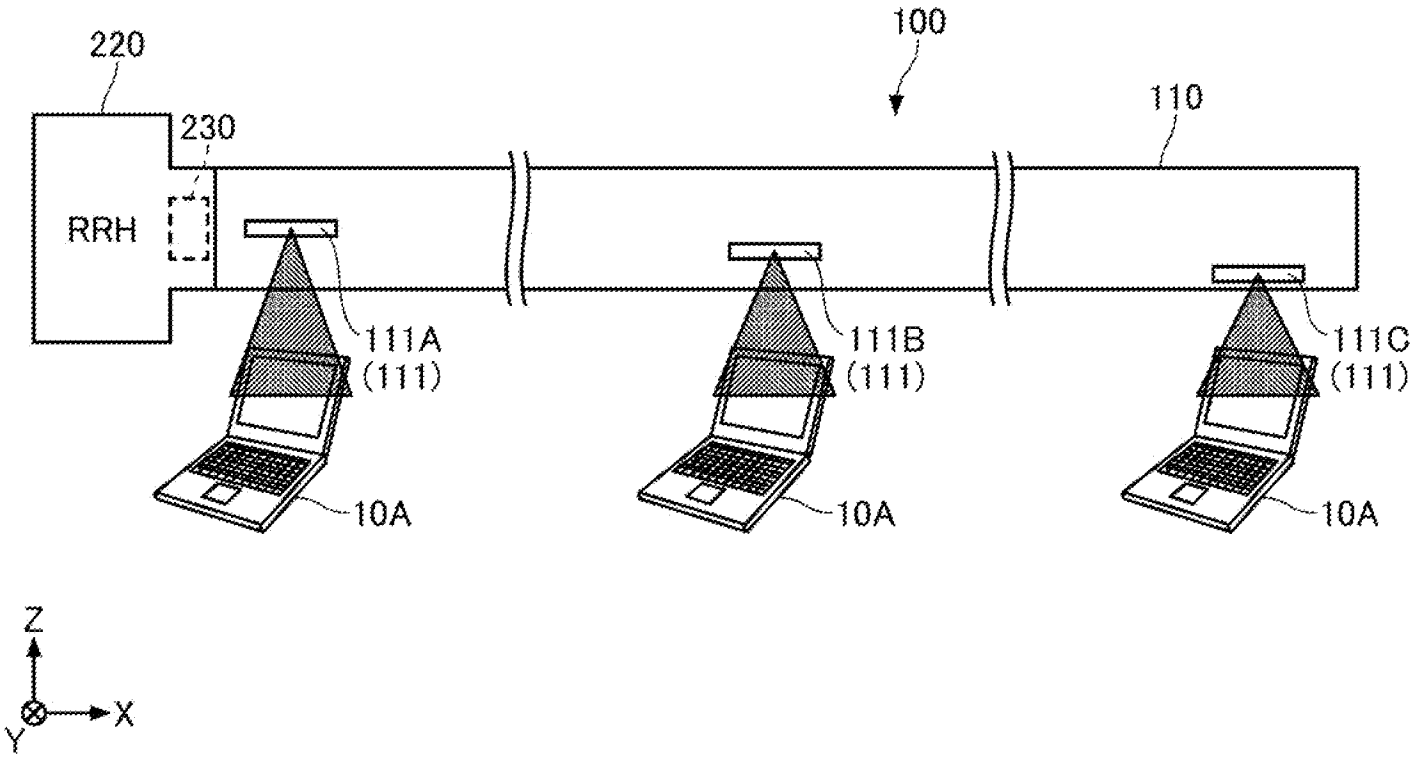
FIG. 3 is a diagram illustrating a configuration of a waveguide.

FIG. 3 is a diagram illustrating a configuration of the waveguide 110. Hereinafter, a common XYZ orthogonal coordinates system will be used to explain the configuration. The waveguide 110 is a rectangular waveguide and has the slots 111A to 111C arranged along an extending direction (the X direction) of the waveguide 110. A cross-sectional shape obtained in the YZ plane of the waveguide 110 is a rectangular shape having short sides extending in the Y direction and long sides extending in the Z direction. The cross-sectional shape in the YZ plane is a cross-sectional shape obtained in a plane perpendicular to the extending direction (the X direction). Accordingly, FIG. 3 illustrates a sidewall including the long sides of the waveguide 110.

The slots 111A to 111C are rectangular openings formed in the sidewall including the long sides. The slots 111A to 111C have longitudinal directions extending along the extending direction (the X direction) of the waveguide 110. The extending direction (the X direction) of the waveguide 110 is the longitudinal direction of the waveguide 110. However, opening shapes of the slots 111A to 111C are not limited to rectangular shapes, the slots 111A to 111C may have rounded long sides and/or rounded short sides, for example. As an example, the waveguide 110 has the three slots 111 (111A to 111C), but the number of slots 111 is not limited to three.

The length of the slot 111 in the longitudinal direction (the X direction) of the slot ill is about a half of the wavelength (about one half of the wavelength) at the communication frequency of the slot antenna apparatus 100. The width of the slot 111 in a short side direction (the Z direction) of the slot 111 may be set to an appropriate width based on emission characteristics or the like of the slot 111.

The waveguide 110 has a length in the extending direction (the X direction) and a width in the 2 direction. The slot 111A is provided at a position which is slightly offset to an edge located in the −Z direction side from a center of the width of the waveguide 110. The slots 111B and 111C are provided at positions which are offset to the −Z direction from the center of the width of the waveguide 110. The offset of the slot 111B from the center is greater than the offset of the slot 111A from the center, and the offset of the slot 111C from the center is greater than the offset of the slot 111B from the center. The positions of the slots 111A to 111C are offset to the −Z direction with respect to the center of the width of the waveguide 110.

Figure 4:
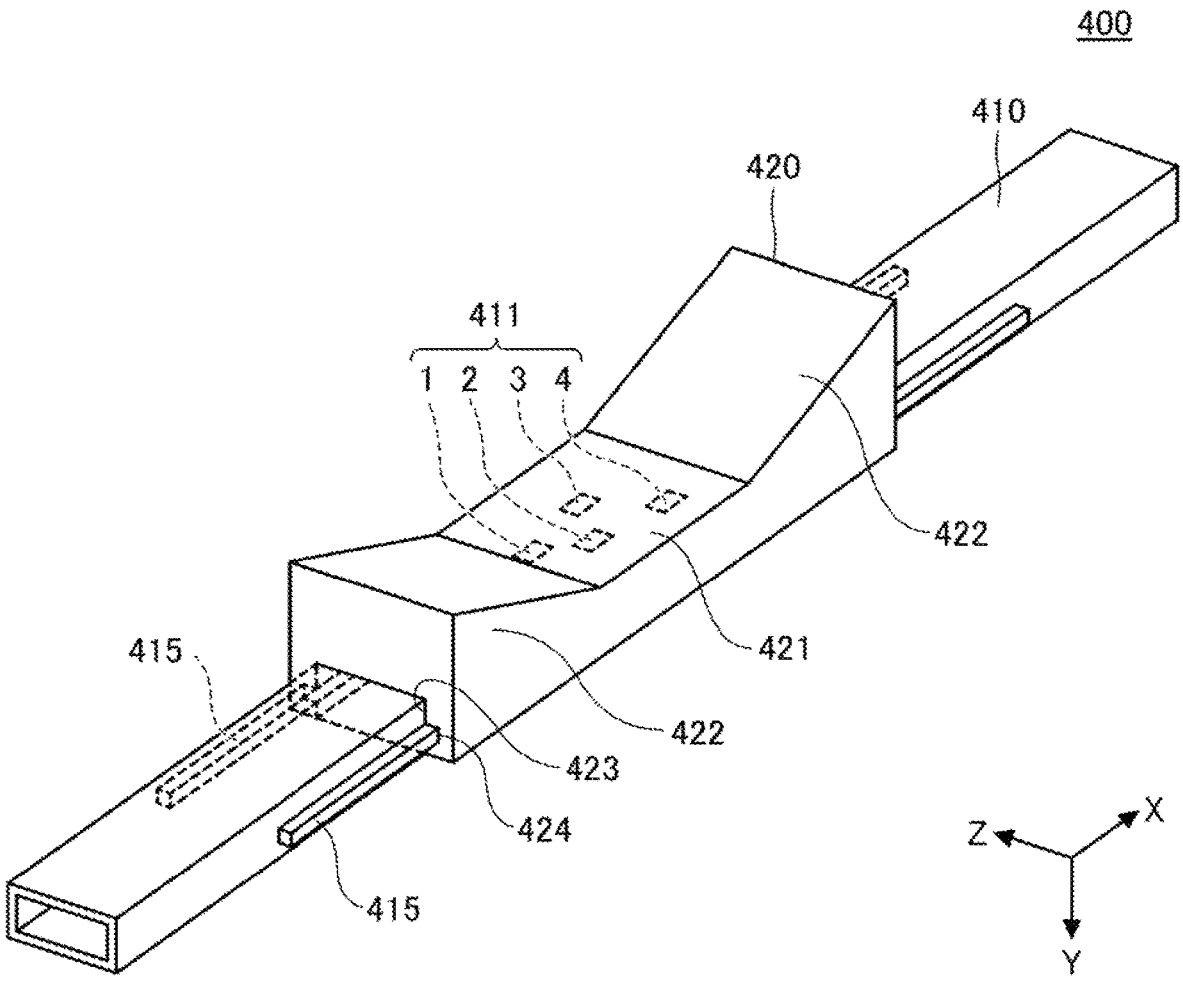
FIG. 4 is a diagram illustrating a slot antenna apparatus according to an embodiment.
Figure 5:
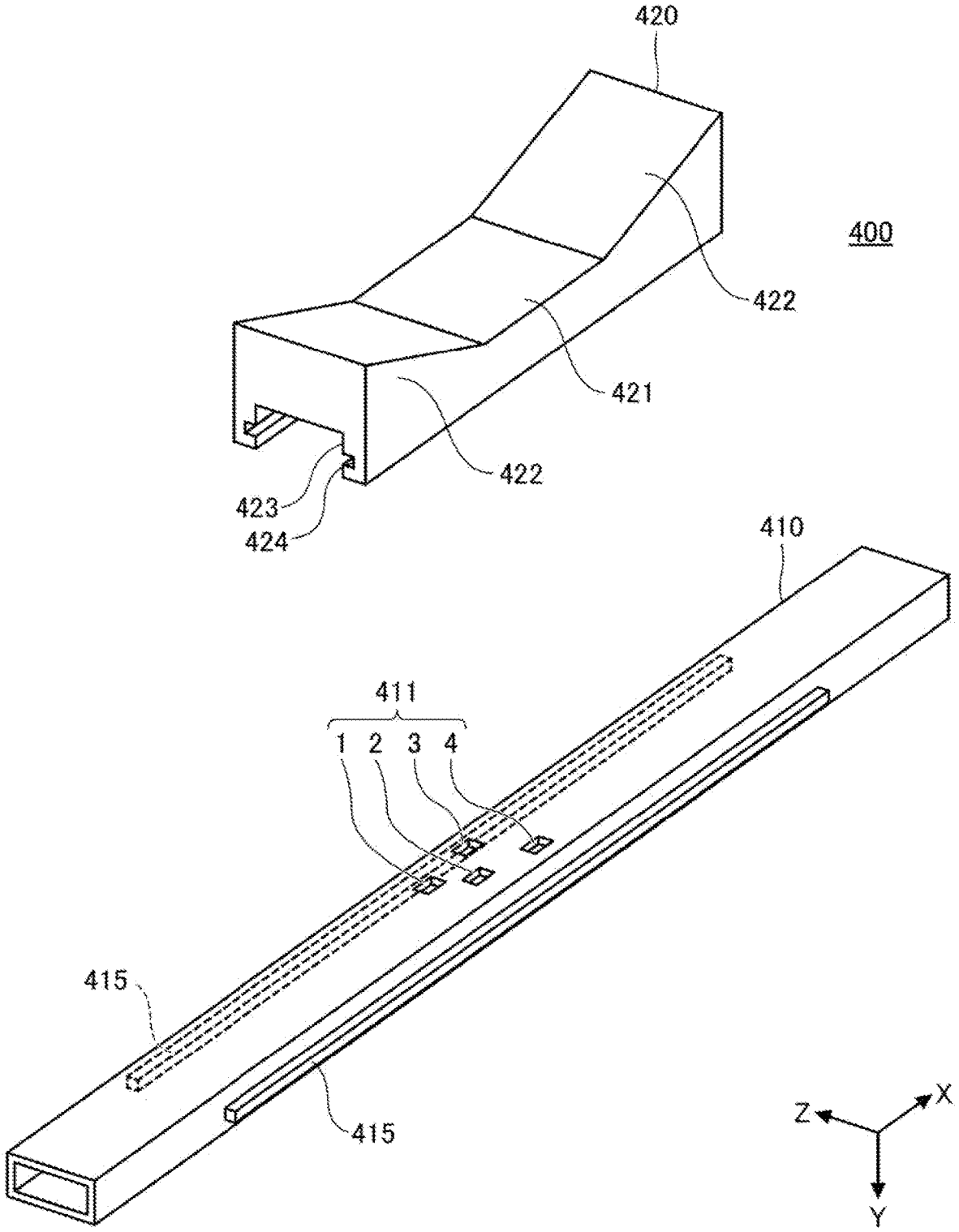
FIG. 5 is a diagram illustrating an exploded view of the slot antenna apparatus according to the embodiment.
Figure 6:
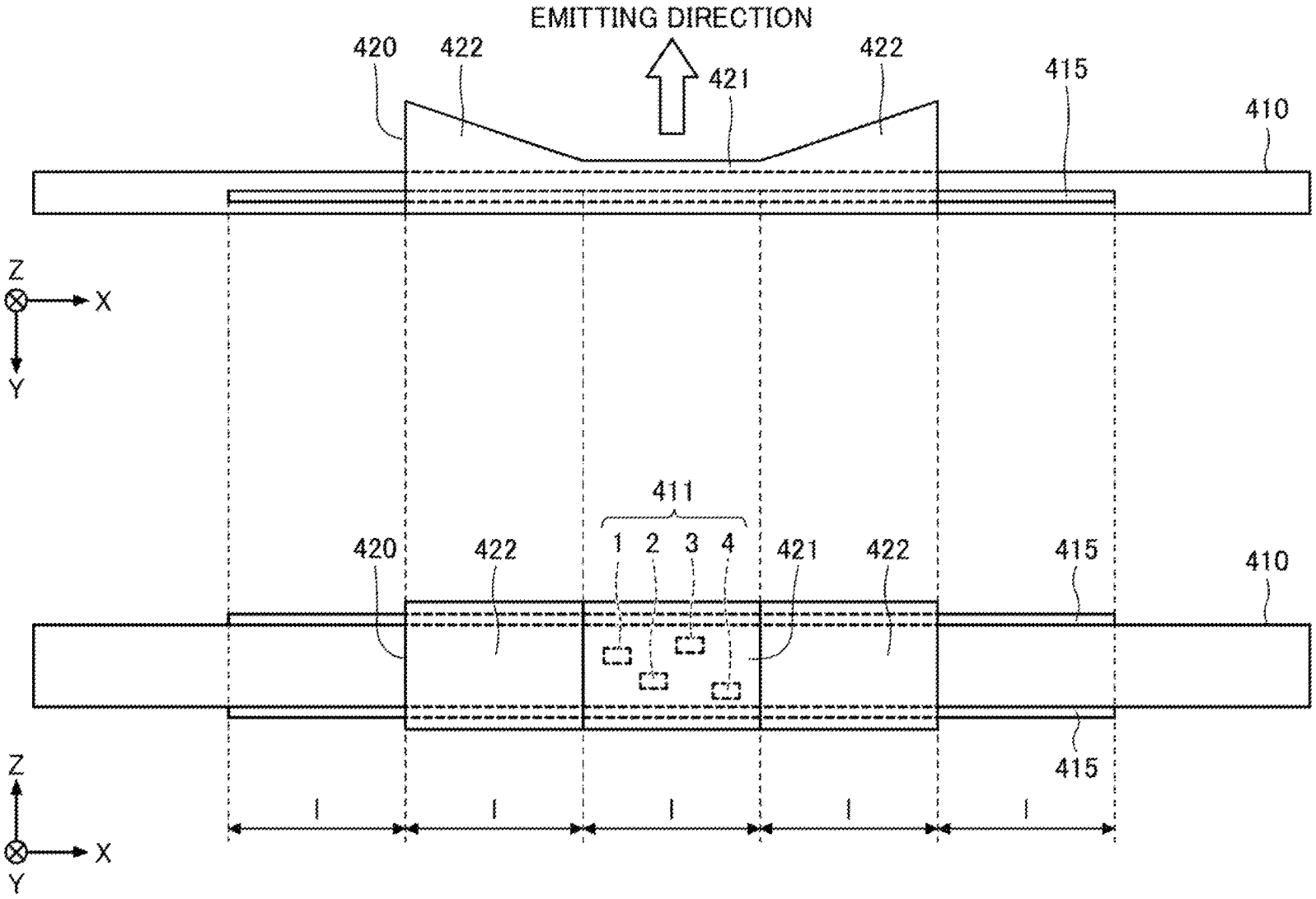
FIG. 6 is a diagram illustrating the slot antenna apparatus according to the embodiment as viewed from two directions.

FIG. 4 is a diagram illustrating a slot antenna apparatus 400 according to the embodiment. FIG. 5 is a diagram illustrating an exploded view of the slot antenna apparatus 400. FIG. 6 is a diagram illustrating the slot antenna apparatus 400 as viewed from two directions. Hereinafter, an XYZ orthogonal coordinate system will be used to explain the slot antenna apparatus 400.

The slot antenna apparatus 400 includes a waveguide 410 and a dielectric member 420. The slot antenna apparatus 400 may be used in the communication system 300 (see FIG. 1) instead of the slot antenna apparatus 100 (see FIG. 1).

The waveguide 410, similar to the waveguide 110, has an advantage of low transmission losses, particularly in a case of transmitting data at a high frequency band (e.g., millimeter-wave band). This is an advantage of the waveguide 410 over coaxial cables which have very high transmission losses at the high frequency band, such as the millimeter-wave band.

The waveguide 410 is a rectangular waveguide and has slots 1 to 4 arranged along an extending direction (the X direction) of the waveguide 410. The slots 1 to 4 constitute a slot array antenna 411. A cross-sectional shape obtained in the YZ plane of the waveguide 410 is a rectangular shape having short sides extending in the Y direction and long sides extending in the Z direction.

Figure 7:
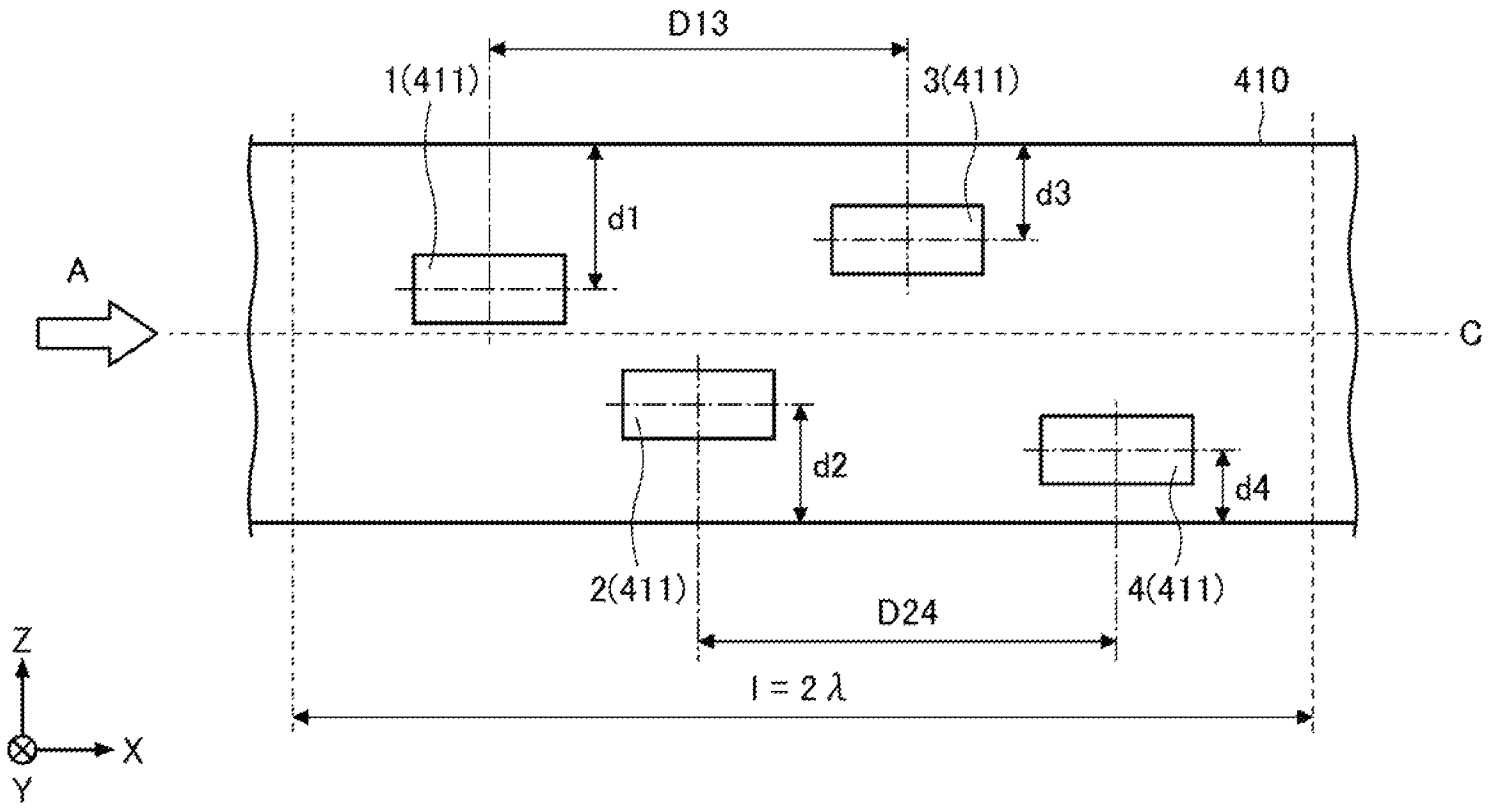
FIG. 7 is a diagram illustrating a slot array antenna.

Here, the slot array antenna 411 will be described with reference to FIG. 7. FIG. 7 is a diagram illustrating an example of the slot array antenna 411.

The slot array antenna 411 includes the slots 1 to 4. Each of the slots 1 to 4 may be the same as the slot ill (see FIG. 3). Each of lengths of the slots 1 to 4 in the longitudinal direction (the X direction) is about a half of a guide wavelength λg (about one half of the guide wavelength) at the communication frequency of the slot antenna apparatus 400. Each of widths of the slots 1 to 4 in the short side direction (the Z direction) of the slots 1 to 4 may be set to an appropriate width based on emission characteristics or the like of the slots 1 to 4. The guide wavelength is a wavelength of the radio wave propagating inside the waveguide 410.

Further, distance D13 between the centers in the X direction of the slots 1 and 3 and distance D24 between the centers in the X direction of the slots 2 and 4 may be more than or equal to a half wavelength of a wavelength λ in a free space at the communication frequency of the slot antenna apparatus 400. A length l, represented by a small l, in FIG. 7 is a length of the single slot array antenna 411 in the X direction. In other words, the length l represents a length of a section in which the single slot array antenna 411 is provided. In the case where a plurality of the slot array antennas 411 are provided, the slot array antenna 411, not illustrated in FIG. 7, located next to the slot array antenna 411 as illustrated in FIG. 7 is provided in a section, that has the length l, next to the section having the length l as illustrated in FIG. 7. The length l is equal to 2λ, i.e., l=2λ.

Here, for example, the radio waves propagate in the waveguide 410 from the −X direction side to the +X direction side, as indicated by arrow A. In order to equalize radiation intensities of the radio waves emitted from the slots 1 to 4, coupling of the waveguide 410 and the slot 1 located on the most upstream side may be minimized, and coupling of the waveguide 410 and the slot 4 on the most downstream side may be maximized.

With respect to a central axis C passing through the center of the width in the Z direction of the waveguide 410, the slots 1 and 3 are located on the +Z direction side, and the slots 2 and 4 are located on the −Z direction side. Regarding the slot 1, a distance d1 is a distance between the center in the Z direction of the slot 1 and a nearer edge of the waveguide 410 in the Z direction from the center in the Z direction of the slot 1. Similarly, regarding the slot 2, a distance d2 is a distance between the center in the Z direction of the slot 2 and a nearer edge of the waveguide 410 in the Z direction from the center in the Z direction of the slot 2. Regarding the slot 3, a distance d3 is a distance between the center in the Z direction of the sloe 3 and a nearer edge of the waveguide 410 in the Z direction from the center in the Z direction of the slot 3. Regarding the slot 4, a distance d4 is a distance between the center in the Z direction of the slot 4 and a nearer edge of the waveguide 410 in the Z direction from the center in the Z direction of the slot 4.

The distances d1 and d3 are distances from a +Z direction-side-edge of the waveguide 410 to the centers of the slots 1 and 3 in the Z direction, respectively. The distances d2 and d4 are distances from a −Z direction-side-edge of the waveguide 410 to the centers of the slots 2 and 4 in the Z direction, respectively. In the waveguide 410, the couplings of the slots 1 to 4 and the waveguide 410 become stronger as locations of the slots 1 to 4 are offset from the center of the width in the Z direction of the waveguide 410. Therefore, d1>d2>d3>d4 is established.

Phases of the radio waves emitted from the slots 1 to 4 are shifted by λ/2 each in this order. The radio waves emitted from the four slots 1 to 4 are emitted as a single beam of the radio waves. Although the slot array antenna 411 has the four slots 1 to 4 in this embodiment, the number of the slots of the slot array antenna 413 may be any number as long as the number is more than or equal to two.

Next, the waveguide 410 and the dielectric member 420 will be described with reference to FIGS. 4 to 6.

The waveguide 410 has guide rails 415 located on both side surfaces parallel to the XY plane. The guide rails 415 are provided on the both side surfaces located on the +Z direction side and the −Z direction side. The guide rails 415 are rails that have rectangular-shaped cross-sections parallel to the YZ plane and extend in the X direction. For example, the guide rails 415 extend over a section having a length of five l in the X direction, and the centers of the guide rails 415 in the X direction correspond to the center in the X direction of the waveguide 410 (see FIG. 6). The guide rails 415 are, for example, made of metal or an insulator.

Positions of the guide rails 415 in the Y direction on the side surfaces of the waveguide 410 may be any position, but in FIGS. 4-6 the guide rails 415 are offset to the +Y direction side with respect to the center of width in the Y direction of the waveguide 410. The dielectric member 420 can slide in the X direction more stably by providing the guide rails 415 on the +Y direction side with respect to the center of the width in the Y direction of the waveguide 410. The positions of the guide rails 415 in the Y direction are constant between ends in the −X direction and ends in the +X direction.

The dielectric member 420 includes a base 421, sloped portions 422, a recessed portion 423, and grooves 424. The dielectric member 420 is a member that is made of dielectric material and has a uniform relative permittivity as a whole. The relative permittivity of the dielectric member 420 is greater than 1, and more specifically greater than the relative permittivity of the air.

The base 421 is an example of a first section of the dielectric member 420. The base 421 is the thinnest portion in the Y direction and is constant in thickness. Sloped portions 422 are provided on the +X direction side and the −X direction side of the base 421. Surfaces of the sloped portions 422 facing toward the −Y direction side are sloped, i.e., inclined.

Each of the sloped portions 422 is an example of a second section of the dielectric member 420. For example, thicknesses of the sloped portions 422 in the Y direction increase linearly in accordance with increased distance from the base 421 in the X direction. Each of the lengths of the base 421 and of the two sloped portions 422 in the X direction is equal to the length l in the X direction of the slot array antenna 411.

The recessed portion 423 is formed to recess from the +Y direction side to the −Y direction side of the dielectric member 420 and extends from an end located on the −X direction side of the dielectric member 420 to an end located on the +X direction side of the dielectric member 420. Inside dimensions of the recessed portion 423 are matched with outside dimensions of the waveguide 410.

The two grooves 424 are provided on an inner wall located on the +Z direction side and an inner wall located on the −Z direction side of the recessed portion 423, respectively. The two grooves 424 have shapes that are matched with the two guide rails 415, respectively, and extend from the end located on the −X direction side of the dielectric member 420 to the end located on the +X direction side of the dielectric member 420.

The dielectric member 420 is provided on the waveguide 410 in a state where the dielectric member 420 spans the waveguide 410 and where the grooves 424 are fitted onto the guide rails 415. Accordingly, the dielectric member 420 is slidable in the X direction with respect to the waveguide 410.

Figure 8:
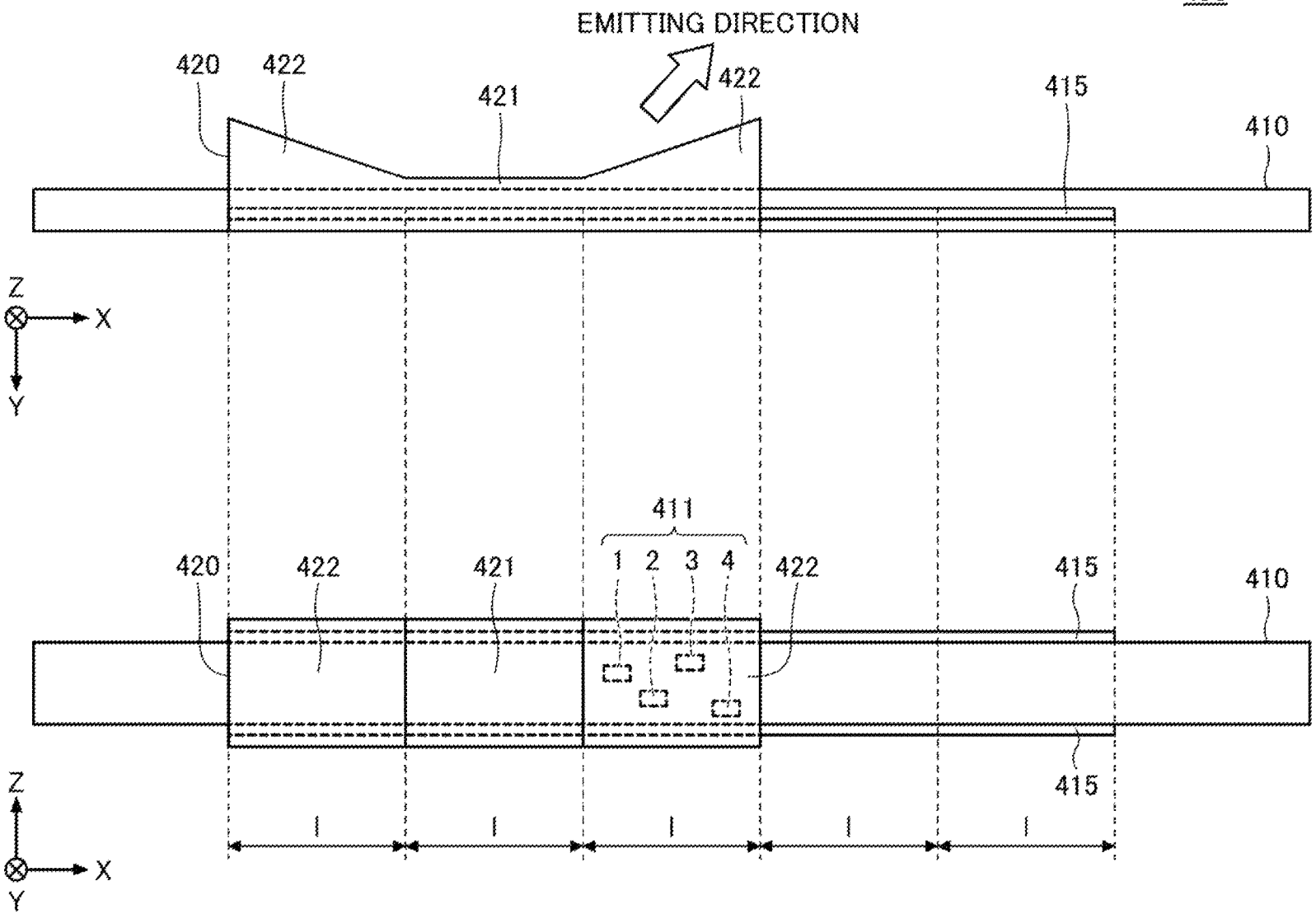
FIG. 8 is a diagram illustrating an operation of the slot antenna apparatus according to the embodiment.
Figure 9:
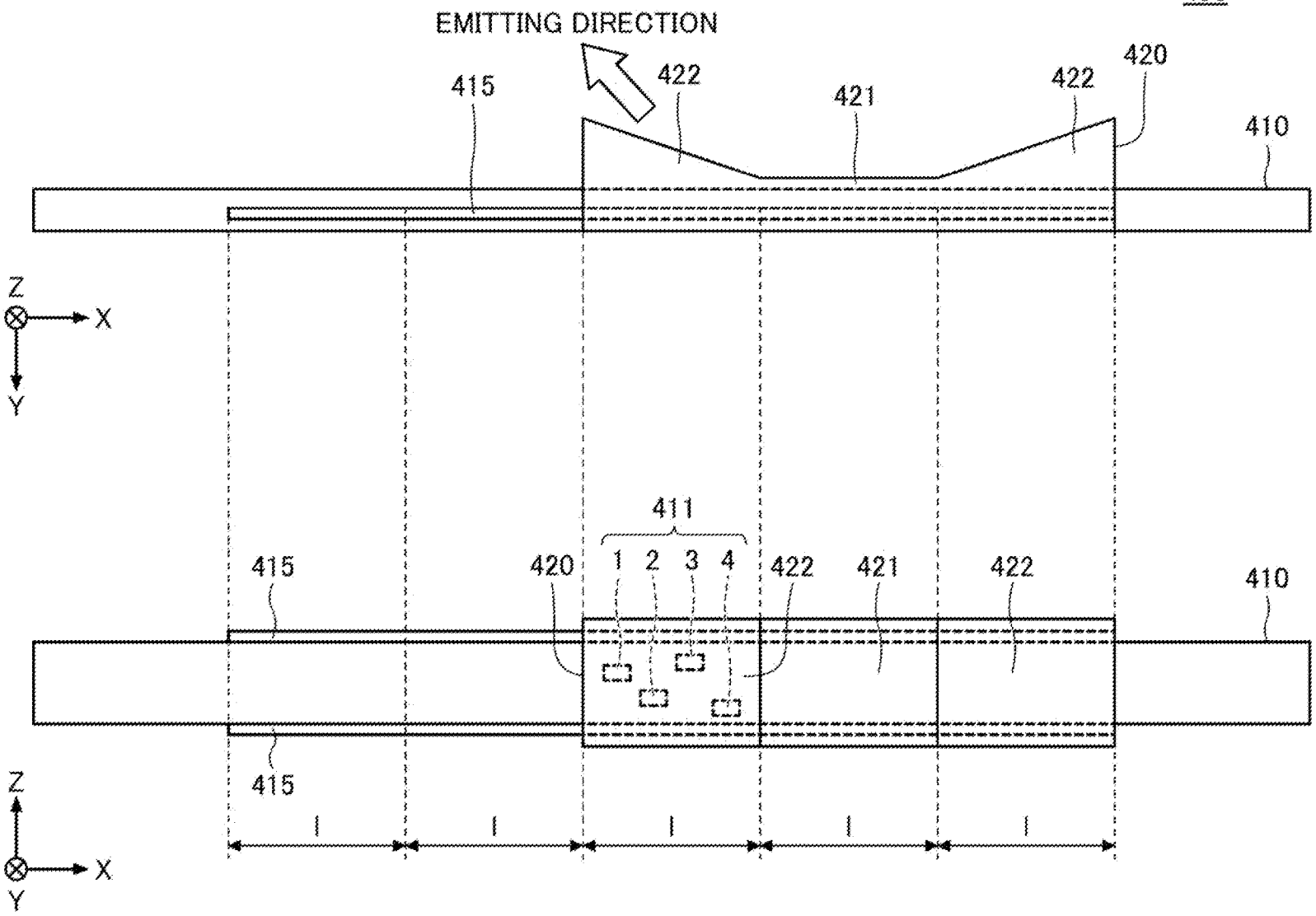
FIG. 9 is a diagram illustrating an operation of the slot antenna apparatus according to the embodiment.

Here, a method for variably adjusting an angle of a beam emitted from the slot antenna apparatus 400 will be described with reference to FIGS. 8 and 9 in addition to FIG. 6. FIGS. 8 and 9 are diagrams illustrating operations of the slot antenna apparatus 400. The radio waves emitted from the slots 1 to 4 are synthesized and form the beam. The angle of the beam is an emission angle of the beam. The emission angle corresponds to an emitting direction as illustrated in FIGS. 6, 8, and 9.

In a case where the base 421 covers the slot array antenna 411 as illustrated in FIG. 6, four portions, of the dielectric members 420, covering the slots 1 to 4, respectively, have same thicknesses. Accordingly, the beam is emitted in the −Y direction, as indicated by an arrow in an upper illustration of FIG. 6. The arrow represents the emitting direction of the beam.

In a case where the dielectric member 420 is slid by the length l in the −X direction from a state as illustrated in FIG. 6 to a state as illustrated in FIG. 8, the sloped portion 422 located on the +X direction side covers the slot array antenna 411.

In this situation, a thickness of a portion, of the dielectric member 420, covering the slot 1 is thinnest, and a thickness of a portion, of the dielectric member 420, covering the slot 4 is thickest among four thicknesses of four portions, of the dielectric member 420, covering the slots 1 to 4, respectively. This means that distances of the four portions through which the radio waves emitted from the slots 1 to 4 pass are different. In a dielectric body, a wavelength becomes shorter as the thickness of the dielectric member 420 becomes thicker, because of wavelength shortening effect. Accordingly, the radio waves emitted from the slot 1 pass through the dielectric member 420 most quickly, and the radio waves emitted from the slot 4 pass through the dielectric member 420 most slowly. Accordingly, the beam that is generated by the synthesization of the radio waves emitted from the slots 1 to 4 is deflected in the +X direction, as illustrated in an upper illustration of FIG. 8.

Accordingly, in a case where the sloped portion 422 located on the +X direction side covers the slot array antenna 411 as illustrated in FIG. 8, it is possible to adjust the emission angle of the beam output from the slot array antenna 411 in the +X direction.

In a case where the dielectric member 420 is slid by the length l in the +X direction from the state 33 illustrated in FIG. 6 to a state as illustrated in FIG. 9, the sloped portion 422 located on the −X direction side covers the slot array antenna 411.

In this situation, a thickness of a portion, of the dielectric member 420, covering the slot 1 is thickest, and a thickness of a portion, of the dielectric member 420, covering the slot 4 is thinnest among four thicknesses of four portions, of the dielectric member 420, covering the slots 1 to 4, respectively. This means that distances of the four portions through which the radio waves emitted from the slots 1 to 4 pass are different. Because of wavelength shortening effect, the radio waves emitted from the slot 1 pass through the dielectric member 420 most slowly, and the radio waves emitted from the slot 4 pass through the dielectric member 420 most quickly. Accordingly, the beam that is generated by the synthesization of the radio waves emitted from the slots 1 to 4 is deflected in the −X direction, as illustrated in an upper illustration of FIG. 9.

Accordingly, in a case where the sloped portion 422 located on the −X direction side covers the slot array antenna 411 as illustrated in FIG. 9, it is possible to adjust the emission angle of the beam output from the slot array antenna 411 in the −X direction.

Figure 10:
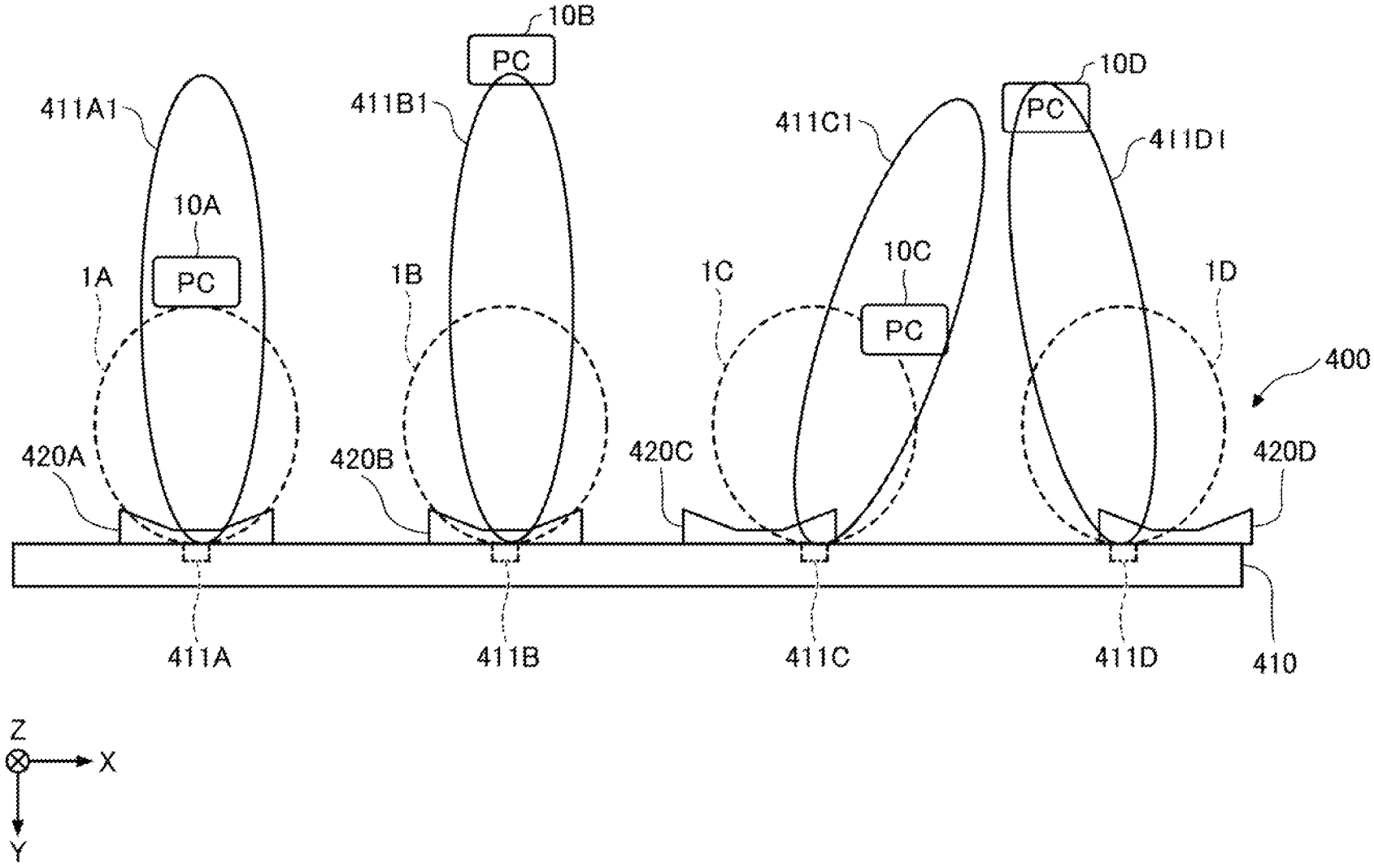
FIG. 10 is a diagram illustrating an operation of the slot antenna apparatus in a case where the slot antenna apparatus includes four slot array antennas.

FIG. 10 is a diagram illustrating an operation of the slot antenna apparatus 400 in a case where the waveguide 410 includes four slot array antennas 411A to 411D. In FIG. 1C, the waveguide 410 is provided with the four slot array antennas 411A to 411D, and the four slot array antennas 411A to 411D are respectively provided with dielectric members 420A to 420D that are slidable with respect to the four slot array antennas 411A to 411D, respectively, in the X direction. Hereinafter, in a case where the dielectric members 420A to 420D are not specifically distinguished, the dielectric members 420A to 420D will be described as the dielectric member(s) 420.

Here, a case where the slot array antennas 411A to 411D supply electric power to PCs 10A to 10D, respectively, will be described.

The slot array antennas 411A to 411D are arranged in the X direction, and each of the slot array antennas 411A to 411D is similar to the slot array antenna 411 as illustrated in FIGS. 4 to 6, 8, and 9. In FIG. 10, the slot array antenna 411 is illustrated in a simplified manner.

The dielectric members 420A to 420D are similar to the dielectric member 420 as illustrated in FIGS. 4 to 6, 8, and 9, and are provided to adjust the emission angles of the slot, array antennas 411A to 411D, respectively.

In FIG. 10, beams 411A1 to 411D1 emitted from the slot array antennas 411A to 411D, respectively, are illustrated as solid ovals. The beams 411A1 to 411D1 represent emission ranges of beams emitted from the slot array antennas 411A to 411D through the dielectric members 420A to 420D, respectively.

For the purpose of comparison, beams 1A to 1D are illustrated by dashed lines. The beams 1A to 1D are respectively emitted from four slots in a 1 slot-to-1 beam relationship without using the dielectric members 420A to 420D, respectively. The four slots that emit the beams 1A to 1D, respectively, are not illustrated in FIG. 10. Each of the four slots has the same approximate emission range as each other and is approximately the same in size as one of the slots 1 to 4 of the embodiment. The four slots that emit the beams 1A to 1D are used instead of the slot array antennas 411A to 411D for the purpose of comparison.

In a case where each of the slot array antennas 411A to 411D and the single slot for comparison emit the radio waves at same power, each of four areas representing the four emission ranges of the beams 411A1 to 411D1, respectively, and each of four areas representing the four emission ranges of the beams 1A to 1D, respectively, are equal to each other. The emission ranges of the beams 411A1 to 411D1 reach farther than the emission ranges of the beams 1A to 1D, and have narrower widths in the X direction and the Z direction than that of the beams 1A to 1D.

In a case where the single slot emits the beam 1A instead of the slot array antenna 411A, the PC 10A is positioned in the emission range of the beam 1A. Accordingly, the PC 10A can receive electric power of the beam 1A. The PC 10A is positioned right in front of the slot array antenna 411A and is positioned in the emission range of the beam 411A1. Accordingly, the PC 10A can receive electric power of the beam 411A1 that is emitted from the slot array antenna 411A and passes through the base 421 (see FIG. 6) of the dielectric member 420A. Since the PC 10A is positioned at the center of the emission range of the beam 411A1, it is appropriate to use the base 421 of the dielectric member 420A. Here, the location of the PC 10A right in front of the slot array antenna 411A means that there is almost no displacement in the X direction with respect to the slot array antenna 411A.

In a case where the slot array antenna 411A outputs the electric power, the beam 411A1 has a longer emission distance than that of the beam 1A and converges. The PC 10A is positioned on a tip of the beam 1A, i.e., the PC 10A is positioned at an end portion in the emission distance of the beam 1A. In contrast, the PC 10A is positioned approximately in the center of the emission distance of the beam 411A1. Therefore, in a case where the slot array antenna 411A outputs the electric power through the base 421, a gain obtained at the position of the PC 10A is increased compared with a case where the single slot outputs the electric power without using the dielectric member 420. As a result, a signal to noise ratio (SNR) and a transmission rate are increased at the position of the PC 10A by supplying the electric power from the slot array antenna 411 through the base 421.

With respect to the PC 10B, in a case where the single slot emits the beam 1B instead of the slot array antenna 411B, the PC 10B is not positioned in the emission range of the beam 1B. Accordingly, the PC 10B cannot receive electric power of the beam 1B. Regarding the slot array antenna 411B, the PC 10B is positioned right in front of the slot array antenna 411B and is positioned in the emission range of the beam 411B1, even though the PC 10B is positioned at a tip of the emission range of the beam 411B1. Accordingly, the PC 10B can receive electric power of the beam 411B1 that is emitted from the slot array antenna 411B and passes through the base 421 (see FIG. 6) of the dielectric member 420B.

In a case where the slot array antenna 411B outputs the electric power, the beam 411B1 has a longer emission distance than that of the beam 1A. Accordingly, it is possible to supply the electric power to the PC 10B from the slot array antenna 411B via the base 421 of the dielectric member 420B, even though the PC 10B is positioned relatively far from the slot array antenna 411B.

With respect to the PC 10C, in a case where the single slot emits the beam 1C instead of the slot array antenna 411C, the PC 10C is positioned in the emission range of the beam 1C. Accordingly, the PC 10C can receive electric power of the beam 1C. Regarding the slot array antenna 411C, the PC 10C is offset to the direction side with respect to a front direction of the slot array antenna 411C. The front direction corresponds to the −Y direction. In this case, it is possible to adjust the emission angle to the +X direction side by sliding the dielectric member 420C to the −X direction side as illustrated in FIG. 10. Accordingly, it becomes possible for the PC 10C to receive the electric power of the beam 411C1.

With respect to the PC 10D, in a case where the single slot emits the beam 1D instead of the slot array antenna 411D, the PC 10D is not positioned in the emission range of the beam 1D. Accordingly, the PC 10D cannot receive electric power of the beam 1D, because the PC 10D is positioned relatively far from the slot array antenna 411D. Regarding the slot array antenna 411D, the PC 10D is offset to the −X direction side with respect to a front direction of the slot array antenna 411D. In this case, it is possible to adjust the emission angle to the −X direction side by sliding the dielectric member 420D to the +X direction side as illustrated in FIG. 10. Accordingly, it becomes possible for the PC 10D to receive the electric power of the beam 411D1.

As described above, it is possible to supply the electric power to the PCs 10A to 10D by utilizing the dielectric members 420A to 420D and by adjusting the emission angles of the slot array antennas 411A to 411D, respectively. Moreover, it is possible to lengthen the emission distances by using the slot array antennas 411A to 411D compared with using the single slot antenna.

In a case where the relative permittivities of the dielectric members 420A to 420D were set to 4, the emission angles, that were obtained similar to the emission angles of the beams 411C1 and 411D1, were +10.1 degrees and −10.1 degrees, respectively, with respect to the −Y direction. Here, the emission angle that is offset in the clockwise direction with respect to the −Y direction as viewed in the XY plane is represented as a plus (+) angle, and the emission angle that is offset in the counterclockwise direction with respect to the −Y direction as viewed in the XY plane is represented as a minus (−) angle. Moreover, in a case where the relative permittivities of the dielectric members 420A to 420D were set to 6, the emission angles, that were obtained similar to the emission angles of the beams 411C1 and 411D1, were +23.3 degrees and −23.3 degrees, respectively, with respect to the −Y direction. Furthermore, in a case where the relative permittivities of the dielectric members 420A to 420D were set to 10, the emission angles, that were obtained similar to the emission angles of the beams 411C1 and 411D1, were +37.2 degrees and −37.2 degrees, respectively, with respect to the −Y direction. Accordingly, it is confirmed that the slot array antennas 411A to 411D can cover the whole emission ranges of the beams 1A to 1D by setting the relative permittivities of the dielectric members 420A to 420D to appropriate values and by sliding the dielectric members 420A to 420D in the X direction with respect to the slot array antennas 411A to 411D.

As described above, it is possible to adjust the emission angles of the slot array antennas 411A to 411D by covering the lot array antennas 411A to 411D with the dielectric members 420A to 420D, respectively, and by sliding the dielectric members 420A to 420D in the X direction with respect to the slot array antennas 411A to 411D. Since the dielectric members 420A to 420D are slidable with respect to the waveguide 410 in the X direction, it is possible to adjust the emission angles easily by sliding the dielectric members 420A to 420D in accordance with the positions of the PCs 10A to 10D. Moreover, in a case where the positions of the PCs 10A to 10D are changed, it is possible to adjust the emission angles.

Accordingly, it is possible to variably adjust the emission angle at which the slot emits the radio waves according to the present embodiment.

Although the embodiment in which the slot array antenna 411 is used is described, the single slot may be used instead of the slot array antenna 411. In particular, it is very beneficial to be able to adjust the emission angle in a case, where the single slot has a relatively narrow beam width. It is also very beneficial to be able to adjust the emission angle even in a case where the single slot has a relatively narrow beam width and a relatively long emission distance.

Although the embodiment in which the dielectric member 420 includes the two sloped portions 422 has been described, the dielectric member 420 may include the single sloped portion 422. The dielectric member 420 may have a configuration in which the four portions covering the slots 1 to 4, respectively, have different thicknesses and are arranged in stepwise shape, instead of including the two sloped portions 422. The dielectric member 420 may have a configuration in which the thicknesses of the sloped portions 422 increase nonlinearly in accordance with increased distance from the base 421 in the X direction, instead of the configuration in which the thicknesses of the sloped portions 422 increase linearly in accordance with increased distance from the base 421 in the X direction. For example, the thicknesses may be increased nonlinearly by having a curved configuration in the XY plane view.

Figure 11:
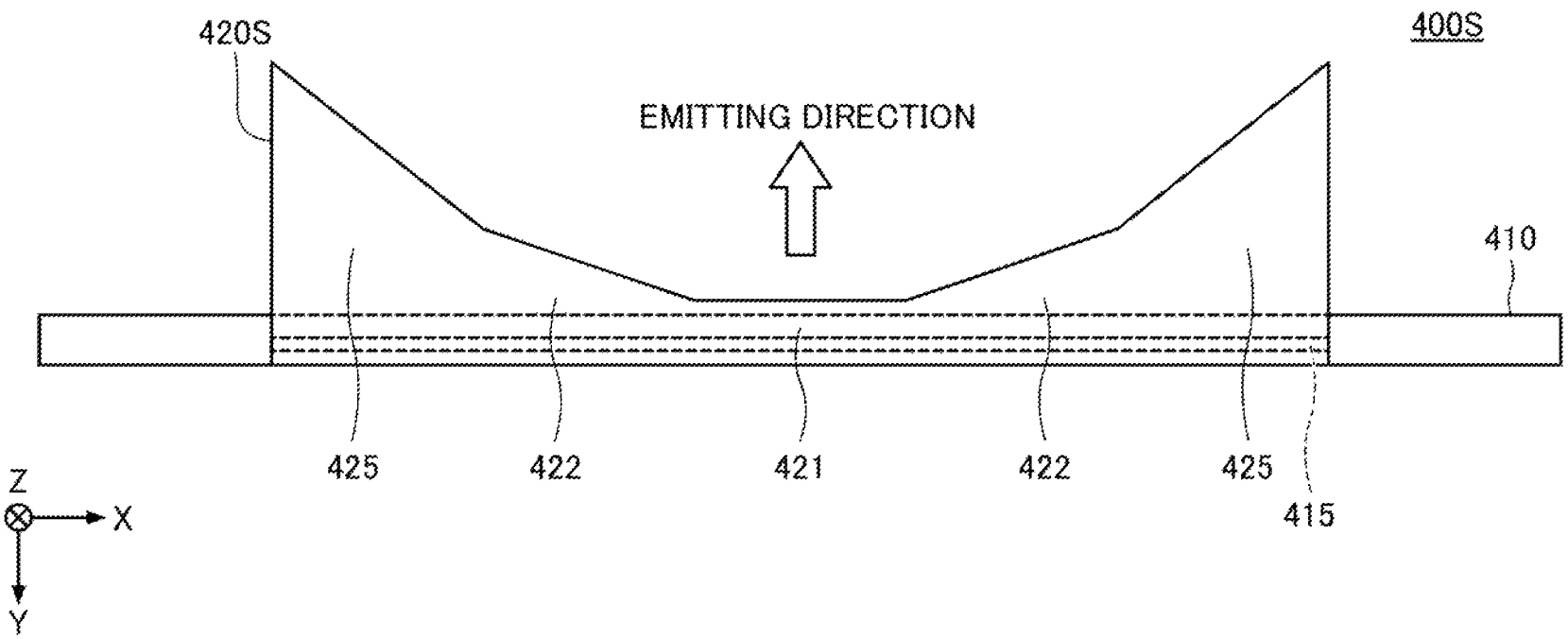
FIG. 11 is a diagram illustrating a slot antenna apparatus according to a first variation of the embodiment.

In addition, a configuration as illustrated in FIG. 11 may be adopted instead of the slot antenna apparatus 400. FIG. 11 is a diagram illustrating a slot antenna apparatus 400S according to a first variation of the embodiment. The slot antenna apparatus 400S includes the waveguide 410 and a dielectric member 420S. The dielectric member 420S includes the base 421, the two sloped portions 422, and two sloped portions 425. The dielectric member 420S has a configuration in which the two sloped portions 425 are added to the dielectric member 420 as illustrated in FIGS. 4-6, 7, and 8. Each of the sloped portions 425 is an example of a third section. The sloped portions 425 are thicker than the sloped portions 422. Surfaces, of the sloped portions 425, located on the −Y direction side have larger tilt angles with respect to the X direction than the surfaces, of the sloped portions 422, located on the −Y direction side.

It becomes possible to further increase the emission angle of the beam emitted from the slot array antenna 411 by sliding the dielectric member 420S so that the sloped portion 425 covers the slot array antenna 411.

Figure 12:
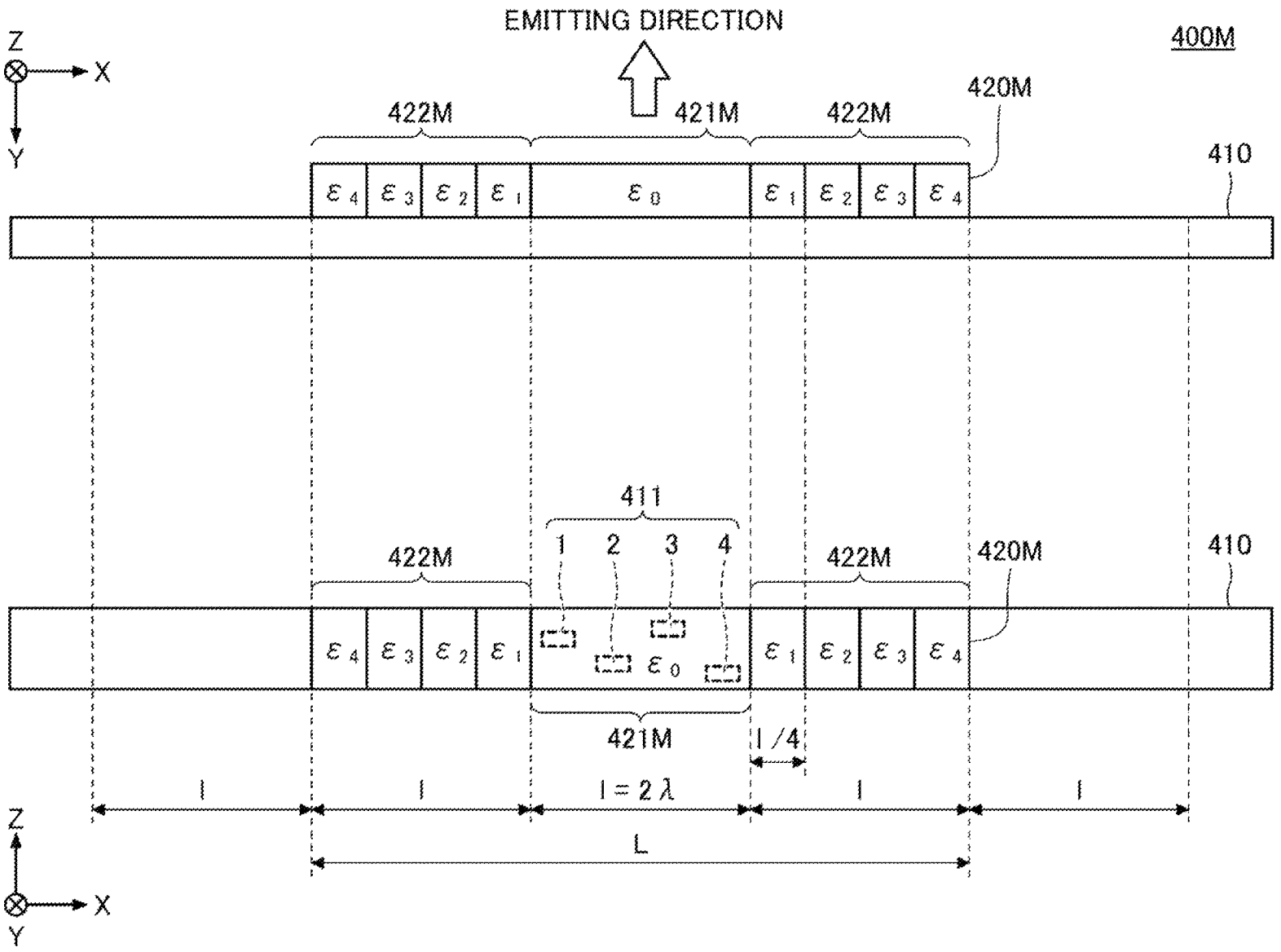
FIG. 12 is a diagram illustrating a slot antenna apparatus according to a second variation of the embodiment.

Although the embodiment in which the thickness of the dielectric member 420 varies in the X direction is described, a dielectric member 420M as illustrated in FIG. 12 may be used instead of the dielectric member 420. FIG. 12 is a diagram illustrating a slot antenna apparatus 400M according to a second variation of the embodiment.

The slot antenna apparatus 400M includes the waveguide 410 and the dielectric member 420M. In FIG. 12, the waveguide 410 is illustrated in a simplified manner and the guide rails 415 (see FIG. 6) are omitted. Further, the dielectric member 420M is also illustrated in a simplified manner, and differences between the dielectric member 420M and the dielectric member 420 (see FIG. 6) will be described.

The dielectric member 420M includes a base 421M and two side portions 422M. The base 421M is an example of a first section of the dielectric member 420M, and each of the side portions 422M is an example of a second section of the dielectric member 420M. Thicknesses of the base 421M and the two side portions 422M in the Y direction are constant.

The base 421M is a portion having a relative permittivity that is set to $\varepsilon_0$. Each of the two side portions 422M has a configuration in which a relative permittivity increases at regular intervals in accordance with increased distance from the base 421M. More specifically, the side portion 422M includes four sections (portions) arranged in the X direction, and relative permittivities of the four sections increase in accordance with increased distance from the base 421M. The relative permittivities of the four sections are set to $\varepsilon_1$, $\varepsilon_2$, $\varepsilon_3$, and $\varepsilon_4$ ($\varepsilon_0<\varepsilon_1<\varepsilon_2<\varepsilon_3<\varepsilon_4$). The side portion 422M is a portion in which the relative permittivities increase in accordance with increased distance from the base 421M. Each of lengths of the four sections in the X direction is a quarter of the length l, i.e., ¼.

Figure 13:
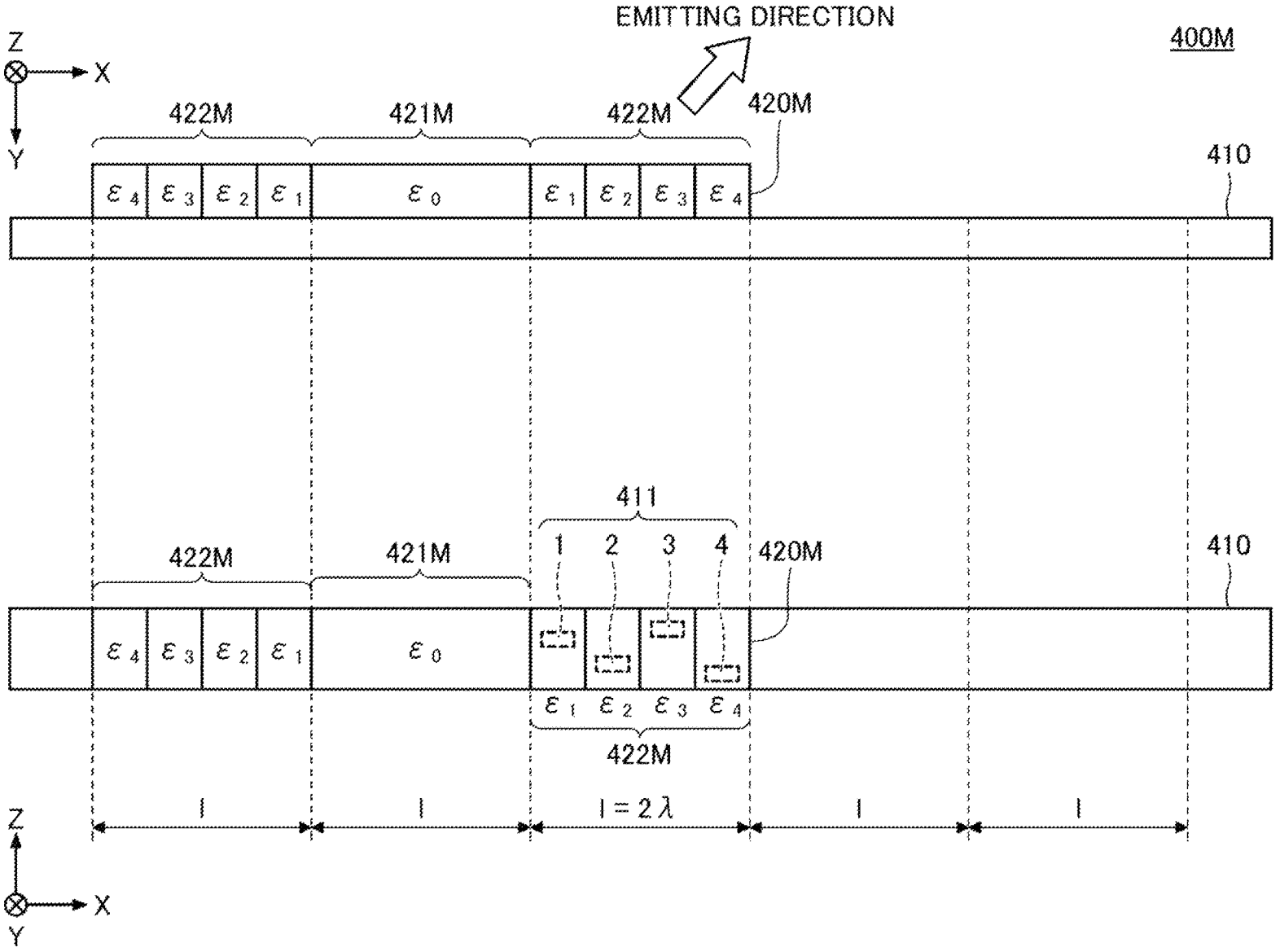
FIG. 13 is a diagram illustrating an operation of a slot antenna apparatus according to the second variation of the embodiment.
Figure 14:
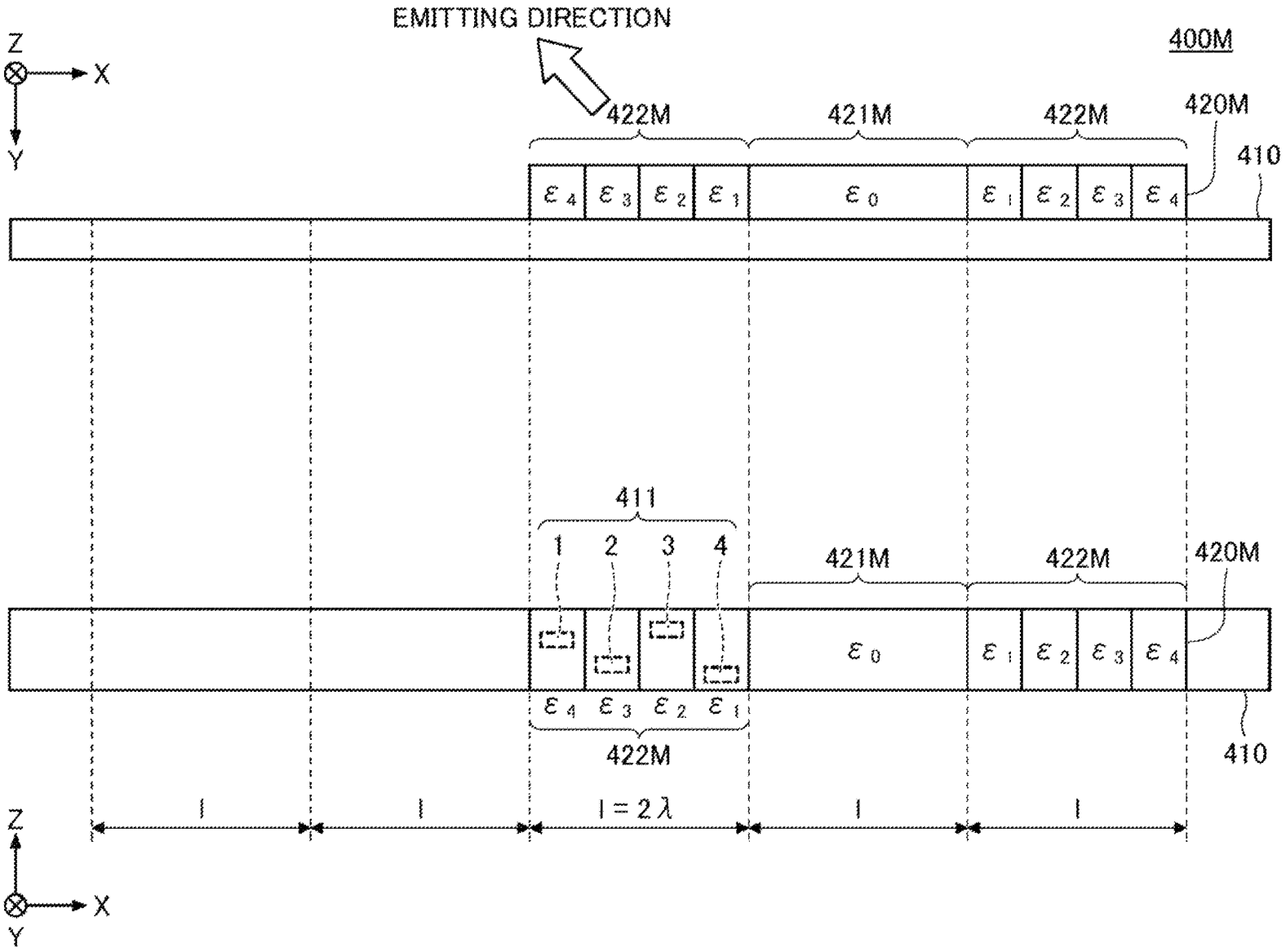
FIG. 14 is a diagram illustrating an operation of a slot antenna apparatus according to the second variation of the embodiment.

Next, adjustments of the emission angles in the slot antenna apparatus 400M will be described with reference to FIGS. 13 and 14 in addition to FIG. 12. FIGS. 13 and 14 are diagrams illustrating operations of the slot antenna apparatus 400M.

As illustrated in FIG. 12, in a case where the base 421M covers the slot array antenna 411, thicknesses of four portions, of the dielectric members 420M, covering the slots 1 to 4 are same with each other, and the relative permittivities of the four portions are the same with each other. The relative permittivities of the four portions are $\varepsilon_0$. Accordingly, the beam is emitted in the −Y direction as illustrated by the arrow in an upper illustration of FIG. 12.

In a case where the dielectric member 420M is slid by the length l in the −X direction from a state as illustrated in FIG. 12 to a state as illustrated in FIG. 13, the side portion 422M located on the +X direction side covers the slot array antenna 411.

In this situation, the relative permittivity of the section, of the dielectric member 420M, covering the slot 1 is smallest, i.e., $\varepsilon_1$, and the relative permittivity of the section, of the dielectric member 420M, covering the slot 4 is largest, i.e., $\varepsilon_4$, among the four relative permittivities of the four sections, of the dielectric member 420M, covering the slots 1 to 4, respectively. This means that, relative permittivities of the four sections through which the radio waves emitted from the slots 1 to 4 pass are different. In a dielectric body, a wavelength becomes shorter as the relative permittivity of the dielectric member 420M becomes greater, because of wavelength shortening effect. Accordingly, the radio waves emitted from the slot 1 pass through the dielectric member 420M most quickly, and the radio waves emitted from the slot 4 pass through the dielectric member 420M most slowly. Accordingly, the beam that is generated by the synthesization of the radio waves emitted from the slots 1 to 4 is deflected in the +X direction, as illustrated in an upper illustration of FIG. 13.

Accordingly, in a case where the side portion 422M located on the +X direction side covers the slot array antenna 411 as illustrated in FIG. 13, it is possible to adjust the emission angle of the beam output from the slot array antenna 411 in the +X direction.

In a case where the dielectric member 420M is slid by the length l in the +X direction from the state as illustrated in FIG. 12 to a state as illustrated in FIG. 14, the side portion 422M located on the −X direction side covers the slot array antenna 411.

In this situation, the relative permittivity of the section, of the dielectric member 420M, covering the slot 1 is greatest, i.e., $\varepsilon_4$, and the relative permittivity of the section, of the dielectric member 420M, covering the slot 4 is smallest, i.e., $\varepsilon_1$, among the four relative permittivities of the four sections, of the dielectric member 420M, covering the slots 1 to 4, respectively. This means that relative permittivities of the four sections through which the radio waves emitted from the slots 1 to 4 pass are different. Because of wavelength shortening effect, the radio waves emitted from the slot 1 pass through the dielectric member 420M most slowly, and the radio waves emitted from the slot 4 pass through the dielectric member 420M most quickly. Accordingly, the beam that is generated by the synthesization of the radio waves emitted from the slots 1 to 4 is deflected in the −X direction, as illustrated in an upper illustration of FIG. 14.

Accordingly, in a case where the side portion 422M located on the −X direction side covers the slot array antenna 411 as illustrated in FIG. 14, it is possible to adjust the emission angle of the beam output from the slot array antenna 411 in the −X direction.

As described above, even in a case where the dielectric member 420M including the side portion 422M that has the relative permittivities increase in accordance with increased distance from the base 421M, it is possible to utilize the shortening effect similar to the shortening effect obtained by the sloped portion 422. Accordingly, it is possible to adjust the emission angle of the beam emitted from the slot antenna apparatus 400M.

According to the variation of the embodiment, it is possible to provide the slot antenna apparatus 400M, the communication system, and the method for adjusting the emission angle of the slot antenna apparatus 400M that are capable of variably adjusting the emission angle of the beam, i.e., an emission angle of the radio waves.

Although the embodiment in which the dielectric member 420M includes the two side portions 422M is described, the dielectric member 420M may include the single side portion 422M. The relative permittivities of the side portions 422M may increase from $\varepsilon_2$ to $\varepsilon_4$ continuously instead of increasing stepwisely.

Figure 15:
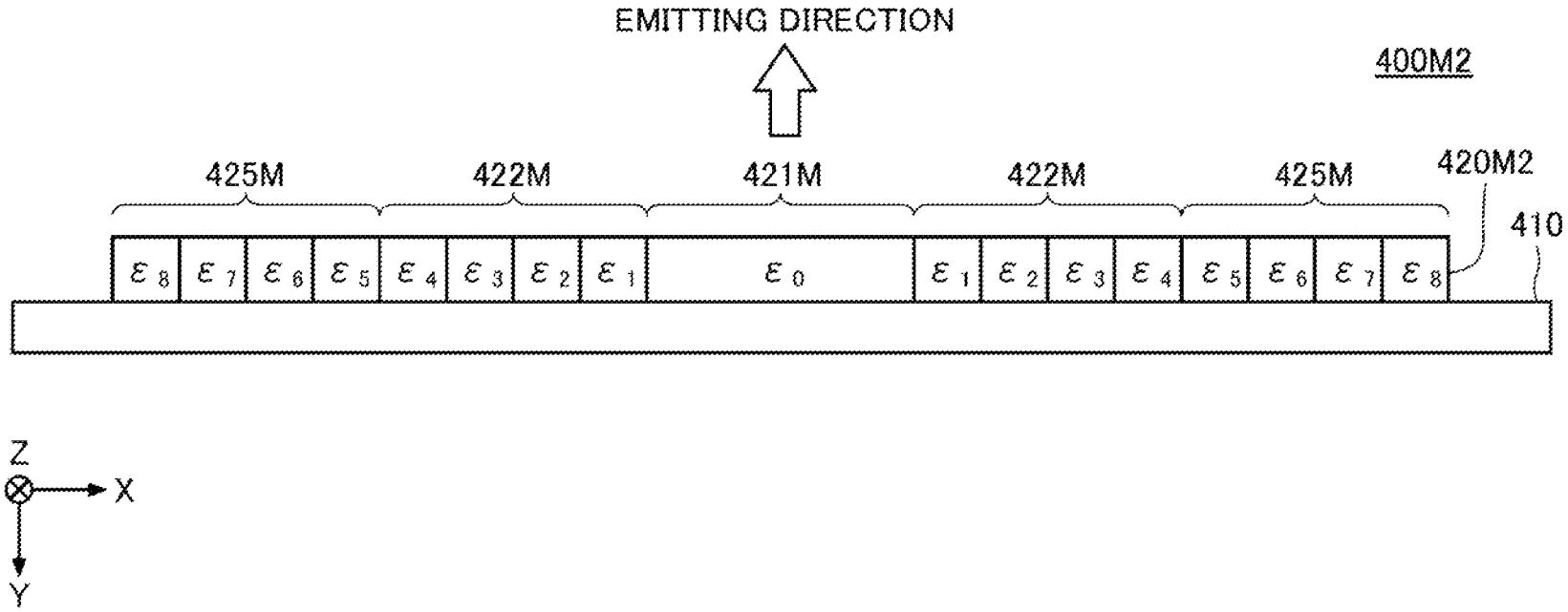
FIG. 15 is a diagram illustrating a slot antenna apparatus according to a third variation of the embodiment.

In addition, a configuration as illustrated in FIG. 15 may be adopted instead of the slot antenna apparatus 400M. FIG. 15 is a diagram illustrating a slot antenna apparatus 400M2 according to a third variation of the embodiment. The slot antenna apparatus 400M2 includes the waveguide 410 and a dielectric member 420M2. The dielectric member 420M2 includes the base 421M, the two side portions 422M, and two side portions 425M. The dielectric member 420M2 has a configuration in which the two side portions 425M are added to the dielectric member 420M as illustrated in FIGS. 12-14. The side portion 425M is an example of a third section of the dielectric member 420M2 and has greater relative permittivities than that of the side portion 422M. Thicknesses in the Y direction of the side portions 425M are equal to that of the base 421M and the side portions 422M.

The side portion 425M includes four sections arranged in the X direction. The relative permittivities of the four sections of the side portion 425M are set to $\varepsilon_5$, $\varepsilon_6$, $\varepsilon_7$, and $\varepsilon_8$ ($\varepsilon_5<\varepsilon_6<\varepsilon_7<\varepsilon_8$), respectively. The side portion 425M is a portion in which the relative permittivities increase in accordance with increased distance from the side portions 422M. Each of lengths in the X direction of the four sections having the relative permittivities $\varepsilon_5$, $\varepsilon_6$, $\varepsilon_7$, and $\varepsilon_8$ is a quarter of the length l, i.e., ¼. The lengths of the four sections of the side portions 425M are equal to the lengths of the four sections of the side portions 422M. The relative permittivities $\varepsilon_5$, $\varepsilon_6$, $\varepsilon_7$, and $\varepsilon_8$ satisfy a relationship represented as $\varepsilon_4<\varepsilon_5<\varepsilon_6<\varepsilon_7<\varepsilon_8$.

Accordingly, the side portions 422M and 425M have configurations in that the relative permittivities of the side portions 422M and 425M increase in a stepwise manner in accordance with increased distance from the base 421M.

It becomes possible to further increase the emission angle of the beam emitted from the slot array antenna 411 by sliding the dielectric member 420M2 so that the side portion 422M or 425M covers the slot array antenna 411.

In the above description, a slot antenna apparatus, a communication system, and a method for adjusting angle of radio waves emitted from the slot antenna apparatus according to embodiments are described. However, the present invention is not limited to the embodiments specifically disclosed. A person skilled in the art may easily achieve various modifications and changes without departing from the scope of the present invention.

The other objects, features, and benefits of the present application may become further clear by referring to the accompanying drawings and embodiments described above.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of superiority or inferiority of the invention. Although the embodiment of the present invention has been described in detail, it should be understood that various changes, substitutions, and alterations could be made hereto without departing from the sprit and scope of the invention.

What is claimed is:

1. A slot antenna apparatus comprising:

a waveguide including a sidewall and having an extending direction;

a slot provided on the sidewall; and a dielectric member that is attached to the waveguide and is slidable in the extending direction with respect to the slot, the dielectric member including a first section and a second section, the first section covering the slot at a first slide position, the second section covering the slot at a second slide position next to the first slide position, and the first section and the second section having different relative permittivities or different thicknesses with each other.

2. The slot antenna apparatus as claimed in claim 1, wherein the first section and the second section have same relative permittivities and different thicknesses with each other.

3. The slot antenna apparatus as claimed in claim 2, wherein a thickness in the second section of the dielectric member is greater than a thickness in the first section of the dielectric member.

4. The slot antenna apparatus as claimed in claim 3, wherein the thickness in the second section becomes thicker in accordance with increased distance from the first section.

5. The slot antenna apparatus as claimed in claim 4, wherein the slot is a slot array antenna that includes a plurality of slots provided along the extending direction, and wherein the second section includes a plurality of portions corresponding to the plurality of slots, respectively, thicknesses of the plurality of portions being different to each other.

6. The slot antenna apparatus as claimed in claim 5, wherein the second section is a sloped portion that has a thickness becoming greater in accordance with increased distance from the first section.

7. The slot antenna apparatus as claimed in claim 3, wherein the dielectric member further includes a third section that is provided next to the second section and is located on an opposite side with respect to the first section, and wherein the third section has a same relative permittivity as the relative permittivities of the first section and the second section, and has a thickness greater than the thickness of the second section.

8. The slot antenna apparatus as claimed in claim 2, wherein the second section includes two second sections provided on both ends of the first section, respectively, and wherein thicknesses of the two second sections are greater than a thickness of the first section.

9. The slot antenna apparatus as claimed in claim 8, wherein the thicknesses in the second sections become greater in accordance with increased distance from the first section.

10. The slot antenna apparatus as claimed in claim 9, wherein the slot is a slot array antenna that includes a plurality of slots provided along the extending direction, and wherein each of the second sections includes a plurality of portions corresponding to the plurality of slots, respectively, thicknesses of the plurality of portions being different to each other.

11. The slot antenna apparatus as claimed in claim 10, wherein the second sections are sloped portions that have thicknesses becoming greater in accordance with increased distance from the first section.

12. The slot antenna apparatus as claimed in claim 1, wherein the first section and the second section have same thicknesses and different relative permittivities with each other.

13. The slot antenna apparatus as claimed in claim 12, wherein a relative permittivity in the second section of the dielectric member is greater than a relative permittivity in the first section of the dielectric member.

14. The slot antenna apparatus as claimed in claim 13, wherein the relative permittivity in the second section becomes greater in accordance with increased distance from the first section.

15. The slot antenna apparatus as claimed in claim 13, wherein the dielectric member further includes a third section that is provided next to the second section and is located on an opposite side with respect to the first section, and wherein the third section has a same thickness as the thicknesses of the first section and the second section, and has a relative permittivity greater than the relative permittivity of the second section.

16. The slot antenna apparatus as claimed in claim 12, wherein the second section includes two second sections provided on both ends of the first section, respectively, and wherein relative permittivities of the two second sections are greater than a relative permittivity of the first section.

17. The slot antenna apparatus as claimed in claim 16, wherein the relative permittivities in the second sections become greater in accordance with increased distance from the first section.

18. The slot antenna apparatus as claimed in claim 1, wherein the relative permittivity in the second section becomes greater in accordance with increased distance from the first section, or wherein the thickness in the second section becomes greater in accordance with increased distance from the first section.

19. A communication system comprising:

a base station having a signal input/output terminal; and a slot antenna apparatus connected to the signal input/output terminal;

wherein the slot antenna apparatus includes:

a waveguide including a sidewall and having an extending direction;

a slot provided on the sidewall; and a dielectric member that is attached to the waveguide and is slidable in the extending direction with respect to the slot, the dielectric member including a first section and a second section, the first section covering the slot at a first slide position, the second section covering the slot at a second slide position next to the first slide position, and the first section and the second section having different relative permittivities or different thicknesses with each other.

20. A method for adjusting an angle of radio waves emitted from a slot antenna apparatus, the slot antenna apparatus including:

a waveguide including a sidewall and having an extending direction;

a slot provided on the sidewall; and a dielectric member that is attached to the waveguide and is slidable in the extending direction with respect to the slot, the dielectric member including a first section and a second section, the first section covering the slot at a first slide position, the second section covering the slot at a second slide position next to the first slide position, and the first section and the second section having different relative permittivities or different thicknesses with each other;

the method comprising:

sliding the dielectric member with respect to the waveguide to the first slide position where the first section covers the slot or to the second slide position where the second section covers the slot.

* * * * *